United States Patent [19]

King

[11] Patent Number: 4,779,748

[45] Date of Patent: Oct. 25, 1988

[54] RIDGED CONTAINER CLOSURE

[75] Inventor: Robert F. King, La Habra Heights, Calif.

[73] Assignee: King Plastics, Inc., La Habra Heights, Calif.

[21] Appl. No.: 57,294

[22] Filed: Jun. 2, 1987

Related U.S. Application Data

[62] Division of Ser. No. 742,996, Jun. 10, 1985, Pat. No. 4,691,501.

[51] Int. Cl.[4] ..... B65D 41/48

[52] U.S. Cl. ..... 215/256; 215/321

[58] Field of Search ..... 215/256, 321; 220/306

[56] References Cited

U.S. PATENT DOCUMENTS

| | | | |
|---|---|---|---|
| 2,953,272 | 9/1960 | Mumford et al. | 220/306 |
| 3,172,559 | 3/1965 | Thompson | 220/306 |
| 3,871,544 | 3/1975 | Peyser | 220/306 |
| 4,305,524 | 12/1981 | McLaren et al. | 220/306 |
| 4,407,426 | 10/1983 | McLaren et al. | 220/306 |
| 4,438,857 | 3/1984 | Bullock, III | 215/256 |

*Primary Examiner*—Horace M. Culver

*Attorney, Agent, or Firm*—Knobbe, Martens, Olson & Bear

[57] ABSTRACT

A plastic container lid which has a small ridge protruding from the outer periphery of the lid, at the top corner of the lid. The ridge provides a uniform taper in the outside diameter of the lid, enabling containers to be capped at high speeds by a method that utilizes a spinning rod feed mechanism. The ridged lid is formed by a novel method, utilizing a one-piece mold cavity, fitted with a one piece mold insert. Also, disclosed is a method of fabricating the one-piece mold cavity.

6 Claims, 2 Drawing Sheets

Fig. 3
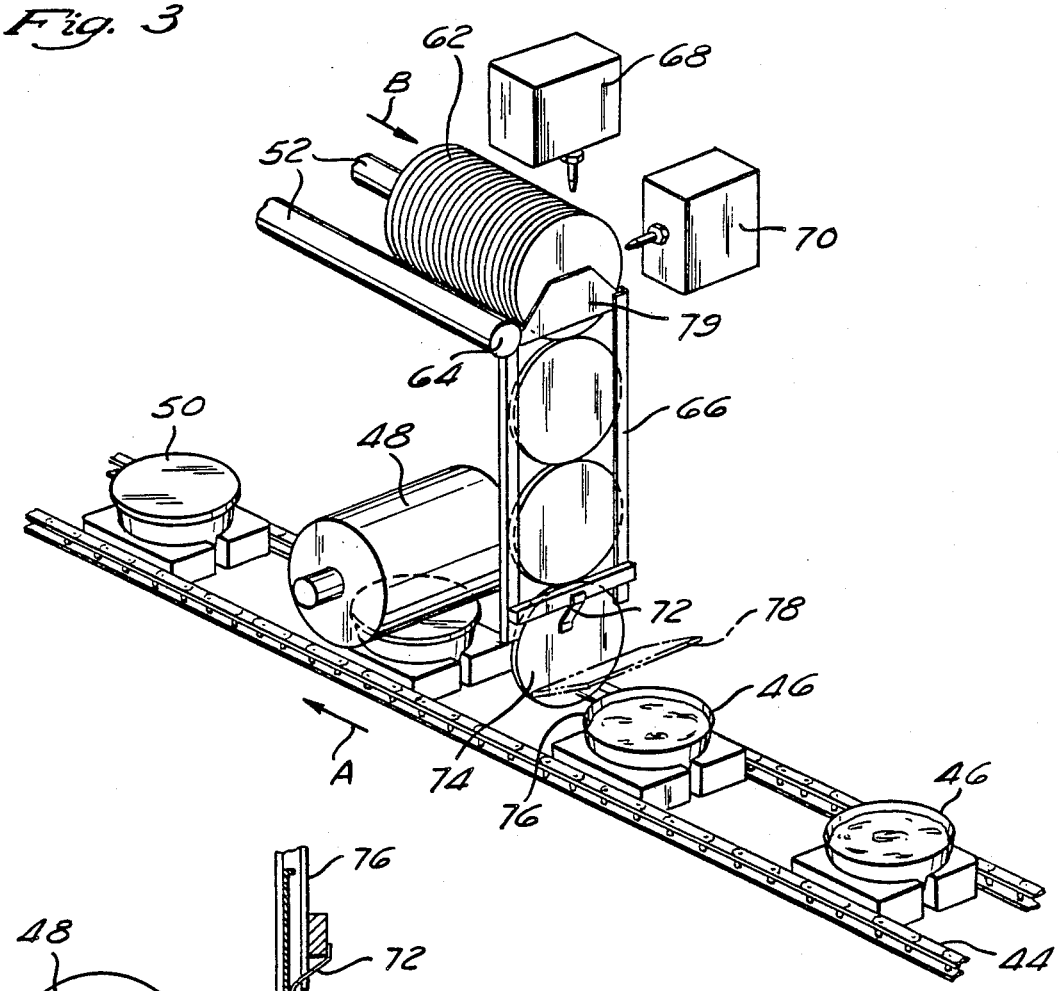
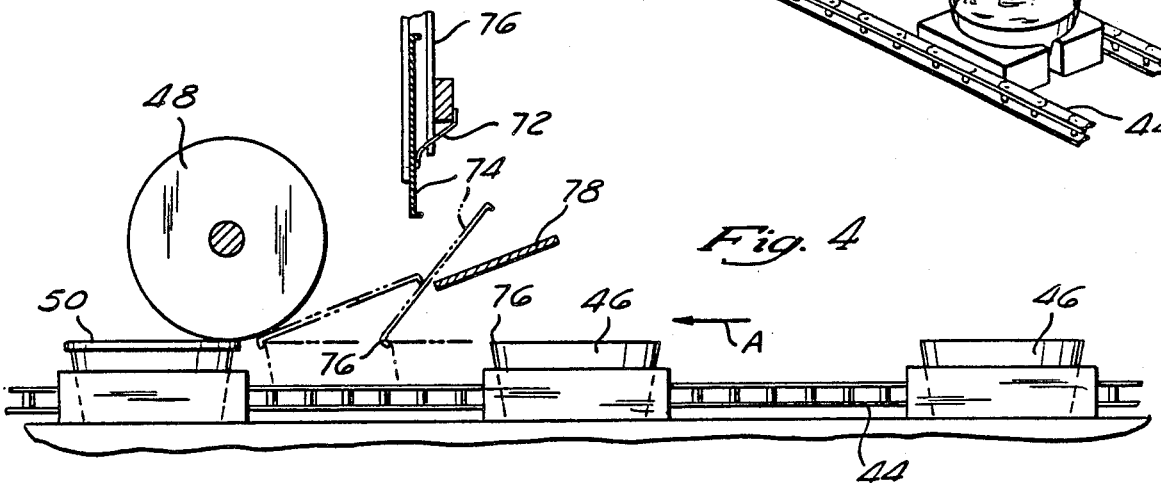
Fig. 4
Fig. 7
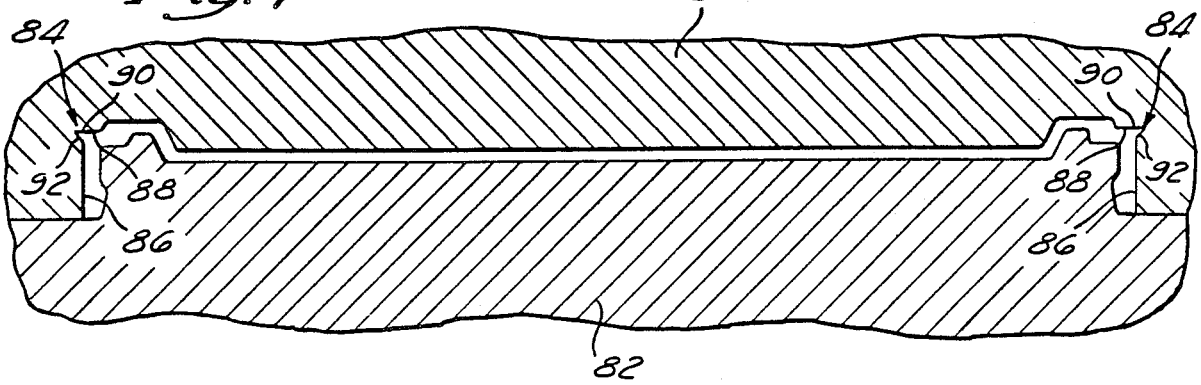

RIDGED CONTAINER CLOSURE

This application is a division, of application Ser. No. 742,996, filed June 10, 1985, and now U.S. Pat. No. 4,691,501.

BACKGROUND OF THE INVENTION

This invention relates generally to container lids, and to methods for forming them and applying them to containers.

Virtually all plastic lids, whether use to cover plastic containers such as margarine tubs or as "overlids" for resealing opened metal containers such as coffee cans, are applied to containers with automatic applicator machines that utilize a rotating rod mechanism to automatically feed the lids along a path. This mechanism consists of a pair of substantially horizontally oriented and substantially parallel rotating rods between which the lids sit on edge. To aid the advancement of the lids with gravity, the rods may be tilted or angled when viewed in side elevation. Also, the rods may deviate from true parallel by diverging or spreading apart in the direction of lid travel. This rotating rod mechanism is also used to transport lids in manufacturing and printing operations.

Previous lids have a preferential tendency to move along the rods in the direction of the bottom of the lid. This is due to the slightly tapered edge or skirt surrounding the perimeter of the lid. Although the mold in which the lid is formed has straight side walls, the skirt "toes in" or becomes narrower the farther it is from the top of the lid, due to the tendency of the skirt to shrink upon cooling to a greater degree at the bottom of the skirt than at the top. The bottom end of the skirt has a large bead protruding internally, which snaps into engagement over a rim on the top of the container to be covered. The difference in shrinkage rates along the skirt results from the variation in thickness of the skirt due to the bead. The lids advance along the rods in the narrowing direction of the taper, regardless of the rotational direction of the rods.

For specialized applications, lids have been produced with a taper which will cause them to walk along the rods in the opposite direction, i.e., towards the top of the lid. This was accomplished by including an external ridge around the bottom of the skirt, which compensated for the taper due to shrinkage, and created a taper in the opposite direction. Thus, the outside diameter of the lid would vary from largest at the bottom of the skirt to smallest at the top of the skirt. These ridged lids are useful only in relatively few circumstances where the machinery is adapted for the lid to advance top-side-forward.

In contrast, shrinkage tapered lids have become widely accepted within the industry and are necessary for the operation of lid applicator machines designed on the assumption that the lids will feed along the rods bottom-side-forward. However, as the thicknesses and lengths of the skirts have become smaller to save material, it has become increasingly difficult to get a consistent taper or toe-in using the shrinkage technique. As a result, shrinkage tapered lids do not feed uniformly on the rotating rods. Some lids feed more slowly than others, creating gaps in the advancing stack of lids on the rods. This decreases the pressure on the lids at the end of the rods which feeds the lids into the applicator. This translates into a lid application rate of at most, 150 containers per minute, despite some applicator's designed capacity of 400 containers per minute.

This low rate of lid application requires either investment in more applicator machines or results in congestion or a backlog at the lid application stage of the capping process. Additionally, inconsistencies in the movement of the lid supply on the rods requires manual intervention in an otherwise automatic process, and may result in uncapped containers being automatically processed in the subsequent packaging operations.

Previous attempts at fabricating a lid with a consistently tapered skirt have been unsuccessful. Typically, plastic lids are injection molded in a twopiece mold comprised of a mold cavity which forms the outer, top surface of the lid, and a removable mold insert which forms the inner, bottom surface of the lid. If the skirt were to be significantly tapered, or narrowed towards the bottom by forming a mold cavity and insert with inwardly sloped or "reversely-tapered" side walls, it would be impossible to remove the mold insert or the lid from the mold cavity since the mold insert and lid would effectively be dove-tailed within the mold cavity.

One solution is to use a split or two-piece mold cavity, however this increases the cost of the mold itself and slows the molding process to a degree which makes the lid prohibitively expensive to produce. Even if the lid could be removed from a one-piece mold cavity with walls angled for a reverse taper, there is a limit to the amount of taper which can be created, since as the inside diameter of the skirt narrows due to the taper, it becomes more difficult to fit the lid over the container.

Thus, a need exists for an inexpensively manufactured container lid which is able to consistently move bottom-side-forward along a pair of spinning rods.

SUMMARY OF THE INVENTION

Briefly stated, the invention comprises a ridged, "reverse tapered" container lid, the term "reverse tapered" defining a lid having an outside diameter which is smaller at the bototm edge of the skirt than at the top. The inventive lid has a small, chamfered ridge surrounding the periphery of the lid at the external corner where the skirt meets the top of the lid. The ridge extends radially outward from the skirt for a distance of approximately 0.010 to 0.012 inches, and is large enough to create a consistent taper in the outside diameter of the lid, despite variations in the amount of shrinkage in the skirt.

Due to the consistent taper, when lids are placed edgewise between a pair of substantially parallel and horizontal rotating rods, the lids will consistently advance along the rods bottom-side-forward, and feed into an applicator machine. When a stack of lids is placed on a pair of rotating rods, the combined tendencies of the individual lids to advance creates a pressure on the lids at the terminal end of the rods. When the lids are on an applicator machine, this pressure holds the lids in place against a deadplate so that the lids may be mechanically dispensed into a chute and down-shuttled to a point where the lids can be automatically placed on top of the container being capped.

Machines capable of capping containers with previous shrink-tapered lids at a maximum rate of 150 containers per minute can now achieve rates as high as 300 containers per minute with the present ridged lid. This 100% increase in capping speed is obtained with absolutely no adjustments or modifications to the applicator machine, and results from the pressure which allows the lids to be mechanically down shuttled onto the containers.

Despite the reverse taper on the ridged lid, it is fabricated by a method which utilizes a straight-walled one-piece mold cavity, and thus the lids can be produced at the same cost and at the same speed as shrink-tapered lids. Due to the relatively small size of the ridge and its beveled edge, the lid can be easily removed from the mold cavity without shearing off the ridge.

The reverse taper mold cavity is formed by machining a chamfered groove in the side wall of a standard, straight-walled mold cavity used in forming shrink-tapered lids.

BRIEF DESCRIPTION OF THE DRAWINGS

FIG. 3 is a perspective view of the applicator machine in FIG. 1, as viewed from lines 3—3 in FIG. 1.

FIG. 4 is a side elevation view of the apparatus as shown in FIG. 3.

FIG. 7 is a cross sectional view of the one piece mold cavity and insert used in fabricating the ridged container lid of FIGS. 5 and 6.

DETAILED DESCRIPTION OF THE PREFERRED EMBODIMENT

Figures 1, 2, 5, 6:
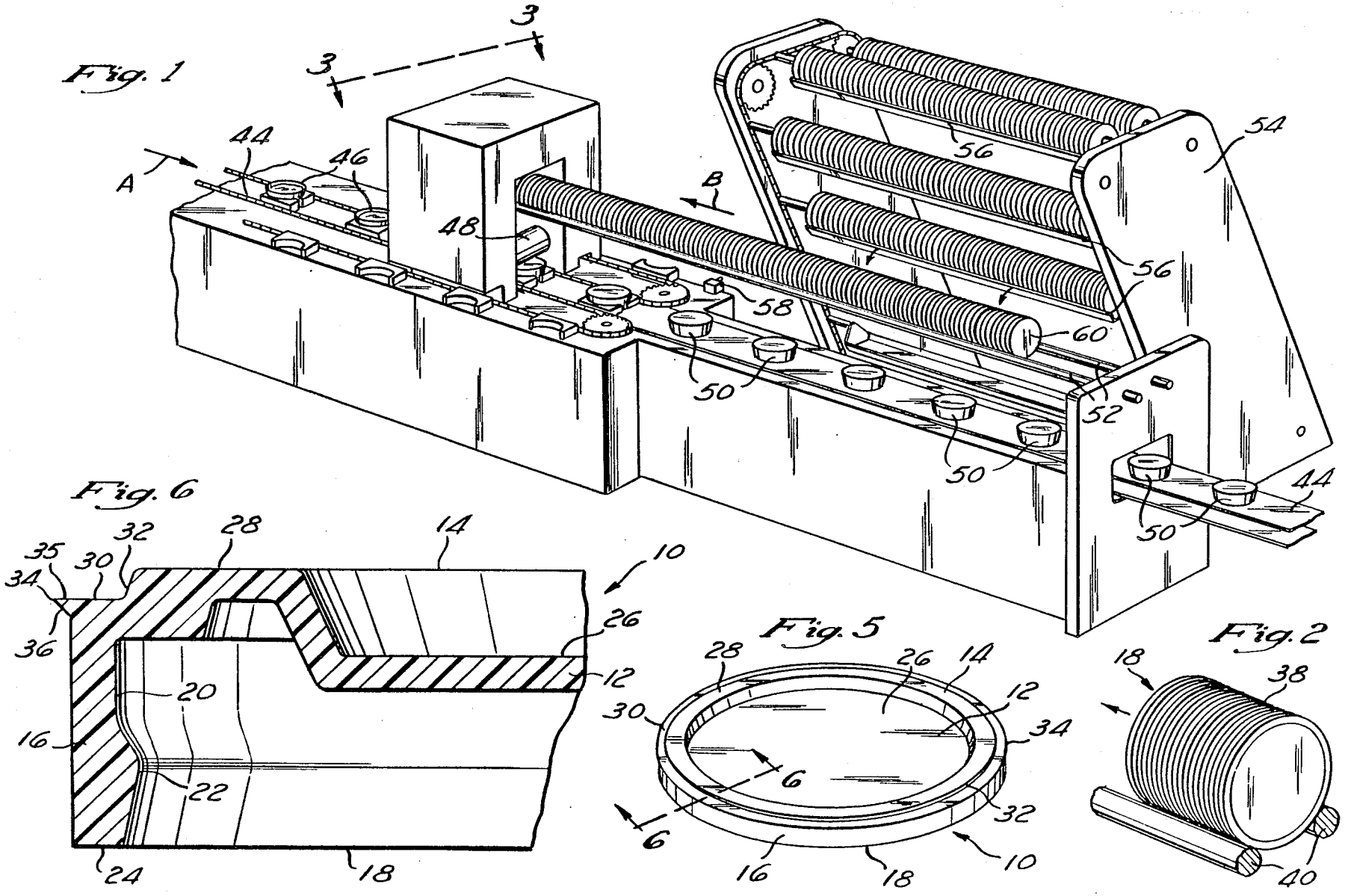
FIG. 1 is a perspective view of a lid applicator machine in operation.
FIG. 2 is a perspective view of a stack of ridged container lids advancing along a pair of parallel rotating rods.
FIG. 5 is a perspective view of a ridged container lid.
FIG. 6 is a cross sectional view of the ridged container lid in FIG. 5, taken along lines 6—6.

As shown in FIGS. 5 and 6, one aspect of the invention comprises an externally ridged container closure or lid 10 used as a removable and reusable container cover.

The lid 10 consists of a substantially circular cover portion 12 on the top side 14 of the lid. Surrounding the periphery of the cover portion 12 is a skirt 16, which depends downwardly from the bottom side 18 of the cover portion. On the internal surface 20 of the skirt 16, is a protruding bead 22 adjacent the bottom edge 24 of the skirt. The bead snaps into engagement with a rim on the top of the container to be covered (not shown).

The cover 12 of the lid consists of a circular, central portion 26, which is surrounded by a raised, annular, stacking lug 28, which itself is surrounded by an annular outer periphery portion 30. The stacking lug 28 enables a series of lids to be placed top to bottom to form a stack. The shoulder 32 formed by the outer portion 30 of the cover and the stacking lug 28 allows the bottom edge 24 and bead 22 of one lid be stacked on the top of the shoulder 32 of another lid while restraining the stacked lids from relative lateral motion.

When the lid is formed from a thermosetting material, the skirt 16 tends to shrink at different rates along its length, due to the increased thickness of the skirt at the bead 22. The variation in shrinkage rates causes the bottom of the skirt to "toe in" or bow inwardly, towards the center of the lid, resulting in a "shrinkage tapered" lid. The lid is tapered because the outside diameter of the lid, measured along the external surface of the skirt, is smaller at the bottom of the skirt than at the top. However, the amount of tapering imparted by shrinkage alone is relatively small, and varies from lid to lid.

In order to achieve a more consistent and greater taper on the outside diameter of the lid, a novel ridge 34 is located on the upper, external corner of the lid, where the skirt meets the outer portion 30 of the cover 12. The ridge 34 protrudes radially outward, beyond the skirt's external surface, so that from the top 14 of the lid to the bottom edge 24 of the skirt, the outside diameter of the lid becomes more narrow, or toed in, resulting in a tapered lid.

The top side 35 of the ridge 34 is level with the top side of the outer periphery portion 30 of the cover. The bottom side 36 of the ridge is chamfered, preferably at a 45° angle, from the top side 35 of the ridge. The chamfer on the bottom side 36 allows the ridge 34 to be removed from the mold cavity in which the lid is formed, as discussed in more detail below.

A stack 38 of lids is shown in FIG. 2, resting on a pair of substantially parallel rods 40. The rods 40 may either be angled from the horizontal, or diverging in the direction of the lid travel, as shown by the arrow, to aid the advancement of the lids by gravity. The lids are stacked top to bottom, utilizing the stacking lugs, as discussed above. When the rods 40 are rotated in the same direction, the lids will advance in the direction of the arrow, or bottom-side-18-forward, regardless of the direction of rotation of the rods 40. The tendency of the lids to advance in this direction is enhanced by the external ridge 34. Since the lids rest with the external surfaces of their skirts in contact with the rods 40, the taper in the outside diameter of the lids will cause the lids to leap slightly from the vertical and towards their bottom sides 18. The greater the degree of tapering, the faster the lids will move along the rods. Since each of the lids in the stack has an equivalent degree of tapering due to its ridge, the stack advances uniformly, without separation between the individual lids. The force moving the lids along the rotating rods 40 bottom-side-forward is cumulative, that is, the lids at the front of the stack are being forced ahead by the pressure created by the lids behind them.

This method of transporting lids along a pair of rotating rods is incorporated into automatic lid applicator machines, such as the one shown in FIG. 1. The illustrated applicator machine 42 utilizes a conveyor belt 44 which moves uncapped containers 46 in the direction of arrow A. The uncapped containers are passed beneath a chute (not shown) which positions a lid onto the top of each container. The lids are then pressed into place on the containers by means of a roller 48, and the capped containers 50 are transported by the conveyor 44 to the next stage in the manufacturing process, typically packaging.

The lids are fed into the chute by means of rotating rods 52, which move the lids bottom-side-forward in the direction of arrow B. The lids are automatically fed onto the rods by means of an elevator 54 which has a plurality of racks 56, on which stacks of lids are stored. The elevator 54 automatically unloads a rack of lids onto the rods when a photoelectric eye 58 senses that the trailing end 60 of the lids on the rods 52 has passed it, indicating that there is enough room on the rods 52 to accommodate another stack of lids.

FIG. 3 shows in greater detail the application of the lids onto the uncapped containers 46. An advancing stack of lids 62 is forced off the terminal end 64 of the rotating rods 52, and into a chute 66. A vertically downward pneumatic jet 68 is directed at the top of the lids to provide added force to the lids falling down the chute 66. A horizontal jet 70 is directed sideways at the lids to separate the stacked lids 62 from one another as they drop into the chute. Not shown is a mechanical picker which is located beneath the rods 52 and which grags the lower edge of the lids 10 to force the lids into the chute 66.

The lids in the chute 66 are restrained from falling through the bottom of the chute 66 by a flexible clip 72. The lid 74 at the bottom of the chute 66 is suspended by the slip 72 in a position so that the rim 76 of an advancing uncapped container 46 can hook onto the skirt of the lid 74 and pull the lid 74 past the clip 72 and out of the chute 66 as the uncapped container 46 advances on the conveyor 44 in the direction of arrow A.

As shown in FIG. 4, a flat plate 78 is suspended at an angle beneath the chute 66 so that the lid does not forcefully snap back onto the container 46 as it is pulled out of the chute 66. The container 46 and lid are then passed underneath the roller 48 which forces the bead on the lid to slide over the rim of the container 46, snapping the lid into place on the container 46.

Since the ridged lids 10 of this invention all have a uniform degree of tapering in their outside diameters, they move along the rods 52 at the same high rate, and remain together in the stacked position until they enter the chute 66. When the lids 10 reach the terminal end 64 of the rods 52, the pressure of the stack 62 of advancing lids 10 behind them holds the lids 10 in a constant position against a deadplate 79 so that they can be dispensed down the chute 66. The lids 10 are separated and forced off the rods 52 and into the chute 66 with the assistance of the mechanical picker and the pneumatic jets 68 and 70. The chute 66 remains constantly filled as the lids 10 are consistently fed into the chute as quickly as they are placed onto the containers 46 being capped. When the applicator machine 42 is operating at speed of 220–240 containers per minute, the chute is filled with another lid every $\frac{1}{4}$ second.

Separation along the stack of lids typically occurs with previous shrinkage-tapered lids because there is less pressure to advance each lid along the rods 52. Gaps between the lids results in less pressure forcing the lids to enter the chute 66, and the lids do not enter the chute 66 as quickly as with the lids 10 of this invention. To compensate for this, either the conveyor 44 must be slowed to allow more time for each lid to become properly positioned at the bottom of the chute 66, or certain containers 46 will pass the chute 66 without being capped.

Thus, the tapered ridged lids 10, which are forced into the chute 66 at a consistently high rate, enable applicator machines to consistently and dependably operate at much higher speeds than they are capable of operating with shrinkage-tapered lids.

The ridged lids 10 may also be utilized on other types of applicator machines (not shown) which have spinning rod feed mechanisms but which use different means to apply the lids 10 onto uncapped containers. In such a machine, the pressure created by the advancing stack of lids on the rotating rods will still maintain the lids at the end of the rods in a position to be dispensed onto the container, regardless of the manner in which the dispensing is done.

Preferably, the ridged lid 10 is injection molded from a thermosetting polymer, such as plyethylene. As shown in FIG. 7, the lids are molded within a one piece mold cavity 80 and a one piece mold insert 82. The walls of the mold cavity 80 form the external surface of the lid 10, and the walls of the mold insert 82 form the internal surface of the lid 10.

A groove 84 is cut into the side wall 86 of the mold cavity 80 so that the external surface of the lid 10 will have a ridge 34 on its upper, external corner. The groove 84 is located at the corner where the side wall 86 of the mold cavity 80 meets the top wall 88 of the mold cavity 80. The groove 84 has a top face 90 which is flat and level with the top wall 88 of the mold cavity 80, and a chamfered face 92 in the side wall 86. Preferably, the depth of the groove ranges from approximately 0.010 inches to 0.012 inches, to form a lid 10 with a ridge 34 which protrudes from the external surface of the skirt by the same amount.

Although the mold cavity 80 is shaped so that the lid 10 formed within it will be tapered, or having a greater outside diameter at the top of the lid 10 than at the bottom, the finished lid 10 can easily be removed from the mold cavity 80. This is partially due to the chamfered face 92 of the groove 84 in the side wall of the mold cavity 80. When the mold insert 82 is pulled out of the cavity 80 with the lid 10 still intact on the mold insert 82, the chamfer 92 allows the ridge 34 on the lid formed by the groove 84 to slip out of the cavity 80 without being sheared off the lid 80. Also, the ridge 34 formed on the lid 10 by the groove 84 is small enough so that a slight, reversible flexing of the lid 10 is sufficient to provide enough clearance to slip the ridge 34 out of the groove 84.

In operation, the mold cavity 80 and the mold insert 82 are fitted together, as shown in FIG. 7. The space formed between those mold parts is injected with a thermosetting polymer. After the polymer has cooled sufficiently to set, the mold insert 82 is removed from the mold cavity 80. The lid 10 formed by the polymer remains intact on the mold insert 82 as the insert 82 is removed from the mold cavity 80, due to the bead 22 on the internal surface 20 of the skirt 16. The ridge 34 on the lid 10 deforms slightly as the lid 10 and insert 82 are removed, bu the ridge 34 is small enough so that it remains intact on the lid and so that there is no permanent deformation of the lid, which is still warm and somewhat pliant. The lid 10 is then removed from the insert 82 by mechanical or pneumatic means, not shown.

In removing the lid 10 from the mold insert 82, the skirt 16 must be flexed radially outward so that the bead 22 does not restrain the lid on the insert 82. Due to this flexing, small amounts of permanent deformation in the skirt 16 may occur as the lid is removed from the mold insert 82. The skirt will be widened towards its bottom edge 24, sometimes resulting in the elimination of any taper in the lid due to shrinkage. Removing the lid 10 from the insert 82 may even widen the outside diameter of the lid towards the bottom edge 24 of the skirt 16 enough to cause the lid to advance along a pair of spinning rods top-side-forward, or backwards, away from the chute. Since the ridge 34 provides a significant taper in the outside diameter of the lid, with the top of the lid having a greater diameter than the bottom, these deformations can be tolerated without affecting the desired bottom-side-forward motion of the lid 10 along a pair of spinning rods. The shorter and thinner the skirt 16 is, the more significant these deformations will be. Thus, the ridge 34 allows the production of tapered lids with skirt sizes that are too small to have a consistent shrinkage taper.

If a tapered lid was to be formed by a mold cavity with side walls that were not straight, but in fact tapered inwardly towards the bottom of the cavity, the resulting lid would effectively be wedged in or dovetailed within the mold cavity. Due to this, the mold cavity would necessarily have to be "split" or formed by two separate pieces which could be joined together during molding and separated to allow removal of the lid.

By providing a chamfered groove 84, a standard, straight walled, one piece mold cavity 80 which is commonly used to form shrink-tapered lids can be easily converted to produce ridge-tapered lids. This is achieved by machining a groove 14 in the side wall 86 of the mold cavity, at the corner where the side wall 86 meets the top wall 80. As shown in FIG. 7, the groove 84 has one face 92 chamfered at a 45° angle in the side wall 86, and another other face 90 level with the top wall 88 of the mold cavity 80.

What is claimed is:

1. A lid for covering the top of a container, comprising:

a substantially planar cover portion, having a top side and a bottom side;

a skirt surrounding the perimeter of the cover and extending substantially normal to the plane of the cover and downwardly from the bottom of the cover, said skirt having an externally facing side and an internally facing side;

a bead formed on the internally facing side of the skirt, at the end of the skirt farthest from the bottom of the cover, for providing a snapping locking engagement with a rim on the container to be covered; and a ridge surrounding the upper external corner of the lid, the corner being formed by the joint between the externally facing side of the skirt and the top side of the cover, said ridge providing a consistently tapered outside lid diameter which facilitates the high speed application of the lids on containers by enabling the lids to be fed along a pair of rotating rods in a consistent manner, said ridge structurally adapted to facilitate formation of said lid in a two piece mold and easy extraction of said lid from said two piece mold, said ridge having a chamfered bottom side and a top side which is flat and level with the top of the cover, said ridge being small enough to allow sufficient flexibility of said ridge to be withdrawn from said two piece mold without causing permanent deformation of said lid.

2. The lid of claim 1 wherein said ridge is chamfered at an angle of 45°.

3. The lid of claim 2 wherein said ridge protrudes radially outward from the skirt for a distance of approximately 0.010 to 0.012 inches.

4. The lid of claim 1, further comprising:

a raised, annular stacking lug sufficiently proximal to the periphery of the cover to allow lids to be adjacently stacked top to bottom by mating the lug of one lid with the bead of an adjacent lid cover.

5. The lid of claim 4 wherein the stacking lug circumferentially surrounds the center portion of the cover, said center portion being depressed beneath the level of the outer periphery of the cover, the bead of the adjacently stacked lid resting on said outer periphery of the cover.

6. The lid of claim 1 wherein said top side of said ridge terminates in a joint with said chamfered bottom side of said ridge.

* * * * *